United States Patent [19]

Danforth

[11] Patent Number: 4,482,095

[45] Date of Patent: Nov. 13, 1984

[54] BI-DIRECTIONAL ROTOR AND STATOR IN A VORTICAL CIRCULATION PULPER

[75] Inventor: Donald W. Danforth, Andover, Mass.

[73] Assignee: Bolton-Emerson, Inc., Lawrence, Mass.

[21] Appl. No.: 422,342

[22] Filed: Sep. 23, 1982

[51] Int. Cl.[3] ..... B02C 23/36

[52] U.S. Cl. ..... 241/46.11; 241/261.1

[58] Field of Search ..... 241/21, 28, 46.11, 261.2, 241/242, 261.1, 46.17, 46.08, 189 A

[56] References Cited

U.S. PATENT DOCUMENTS

| | | | |
|---|---|---|---|
| 1,714 | 8/1840 | Montgomery et al. | 241/189 A |
| 2,596,586 | 5/1952 | Morden | 241/261.2 |
| 3,428,261 | 2/1969 | Moulton | 241/21 |

*Primary Examiner*—Mark Rosenbaum

*Attorney, Agent, or Firm*—Pearson & Pearson

[57] ABSTRACT

A vortical circulation pulper, of the type designed to pulp difficult to defiber stock, and having a rotor revolving within a stator, in one wall of a pulp container, to circulate a charge in a path within the container, a rotor/stator, stock reduction, interface alongside the path for reducing the size of chunks to smaller pieces and a rotor/stator stock attrition interface in rear of said stock reduction interface on the path to receive and defiber said smaller pieces is provided with a bidirectional rotor and a bidirectional stator, both having symmetrical, generally, isosceles triangle shaped peaks and valleys therearound. Rotation of the rotor can thus be reversed when its stock reduction edges wear down and such reverse rotation, resharpens the worn edges.

5 Claims, 10 Drawing Figures

Fig. 3.
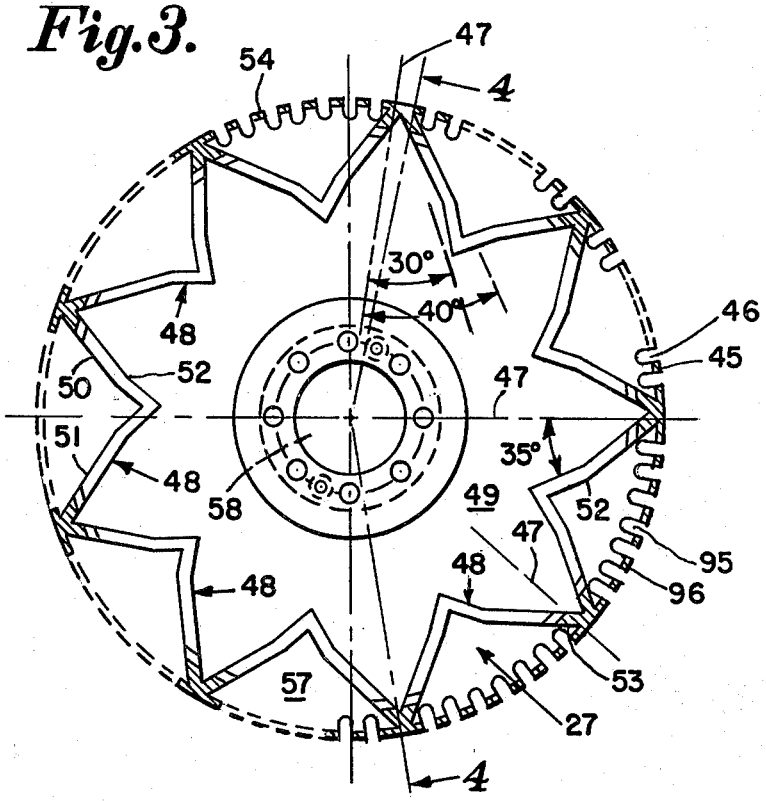
Fig. 4.
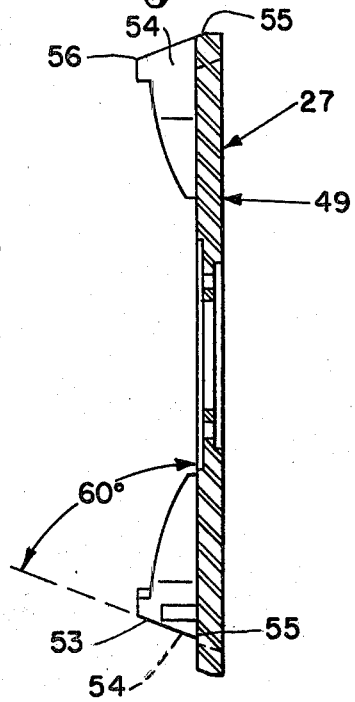
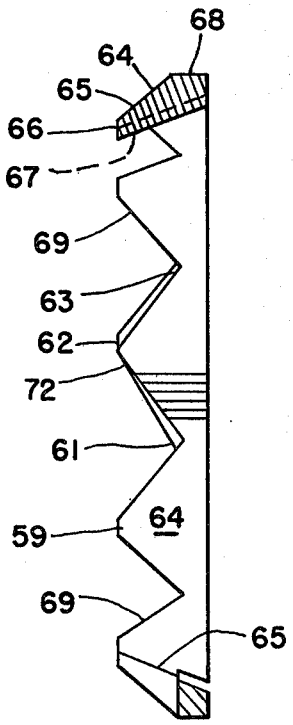
Fig. 5.

Fig. 6.
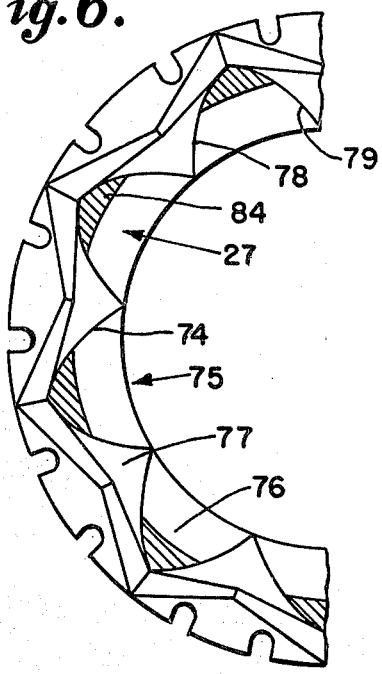
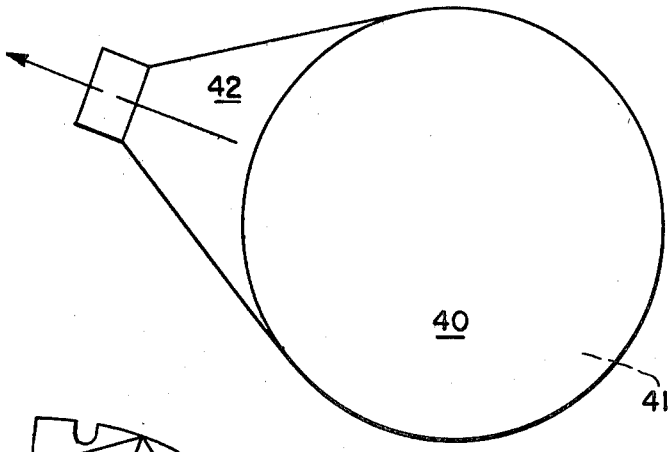
Fig. 8.
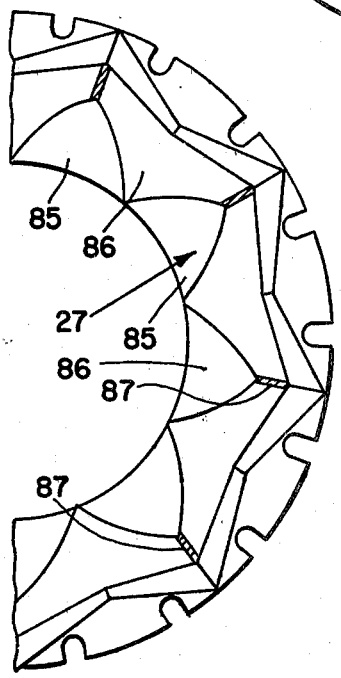
Fig. 7.
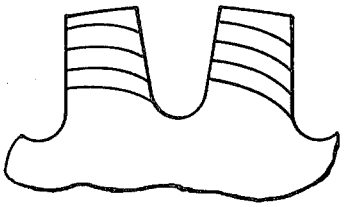
Fig. 9.
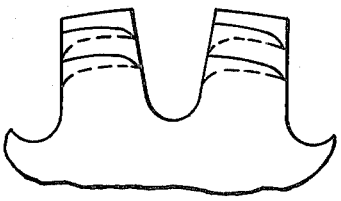
Fig. 10.

BI-DIRECTIONAL ROTOR AND STATOR IN A VORTICAL CIRCULATION PULPER

BACKGROUND OF THE INVENTION

In my U.S. Pat. No. 3,946,951 of Mar. 30, 1976, it was proposed to process difficult to defiber stock such as hemp, flax, rag, leather, synthetic fiber, wet strength paper and the like, in a vortical circulation pulper by reducing the clearance of the rotor/stator blades at the truncated conical attrition interface to zero and increasing the horsepower exerted on the zero clearance rotor at least fifty percent to achieve enough thrust and grinding action to refine the fibers. This operated successfully, but subjected the apparatus to wear at a rapid rate.

In my U.S. Pat. No. 4,365,761 of Dec. 28, 1982 entitled "Apparatus and Method for Defibering Unconventional Material" it is proposed that a rotor/stator stock reduction interface be provided in the path of the vortically circulated stock to reduce large chunks of the unconventional material to smaller pieces so that they may enter the stock attrition interface for defibering. The stator of the apparatus of my said application is symmetrical, and formed of a plurality of identical peaks and valleys which create acquisition valleys for retaining the chunks, each peak having an acquisition edge, so that the stock reduction edges on the rotor vanes will strike the chunks with a scissors-like series of impacts and thereby reduce the chunks to the desired size.

This apparatus and method has been unusually successful, but occasionally the stock reduction blades on the rotor and the stock reduction edges on the stator become worn and require "down time" for resharpening.

SUMMARY OF THIS INVENTION

In this invention, the rotor and stator are similar to the rotor and stator of my said Pat. No. 4,365,761 but the stator is what I call "bi-directional" in that there is an acquisition edge, and an acquisition space, on each opposite side of each peak of the stator to reduce chunks of stock, travelling in either angular direction, and caught therein, in cooperation with the rotor. In addition, the rotor is "bi-directional" in that the vortical circulation vanes are formed by a series of peaks and valleys, similar to those of the stator, with each peak being generally isosceles triangular in shape and having a stock reduction edge on each opposite side of each peak to cooperate with the corresponding acquisition edges of the stator whether rotated in one angular direction or the other. The vortical circulation vanes are thus symmetrical and will create the desired vortical path of circulation in the pulp container regardless of the angular direction of rotation by the shaft of the rotor drive and electric motor.

The erosion of the leading edges of the rotor can be partially compensated by moving the truncated conical rotor further inward into the truncated conical stator, but nevertheless, in the prior art device a progressive rounding of the leading edges develops throughout the life of the rotor and stator.

In contrast, the utilization of the rotor and stator design of this invention permits periodic reversal of direction of rotation of sharp leading edges throughout life. Trailing edges necessarily remain sharp, so that reversal of direction of rotation enables utilization of these sharp edges for maximum efficiency. At the same time, those edges that were leading then become trailing, and as the interface inevitably wears, these edges again become sharp, whereupon direction of rotation is again reversed, etc. Similarly, the same effects occur on the acquisition edges on the peaks of the stator. In this way, the unit can be said to be "self sharpening" i.e.: edge effectiveness is maintained at maximum throughout the life of rotating and stationary elements.

BRIEF DESCRIPTION OF THE DRAWINGS

FIG. 3 is a fragmentary, detail front view of one form of bi-directional rotor vane with peaks and valleys, each peak having a pair of opposite stock reduction edges;

FIG. 4 is a side elevation, in section, on line 4—4 of FIG. 3;

FIG. 5 is a side elevation, in half section, of a stator of the invention;

FIG. 6 is a view similar to FIG. 3 of another embodiment of the rotor of the invention.

FIG. 7 is a view similar to FIG. 3 of still another embodiment of the rotor of the invention;

FIG. 8 is a diagrammatic plan view of the housing of the bi-directional rotor and stator of the invention with radial discharge;

FIG. 9 is a diagrammatic view showing progressive rounding of conventional edges; and FIG. 10 is a view similar to FIG. 9 showing the self sharpening of the edges in this invention.

DESCRIPTION OF A PREFERRED EMBODIMENT

Figure 1:
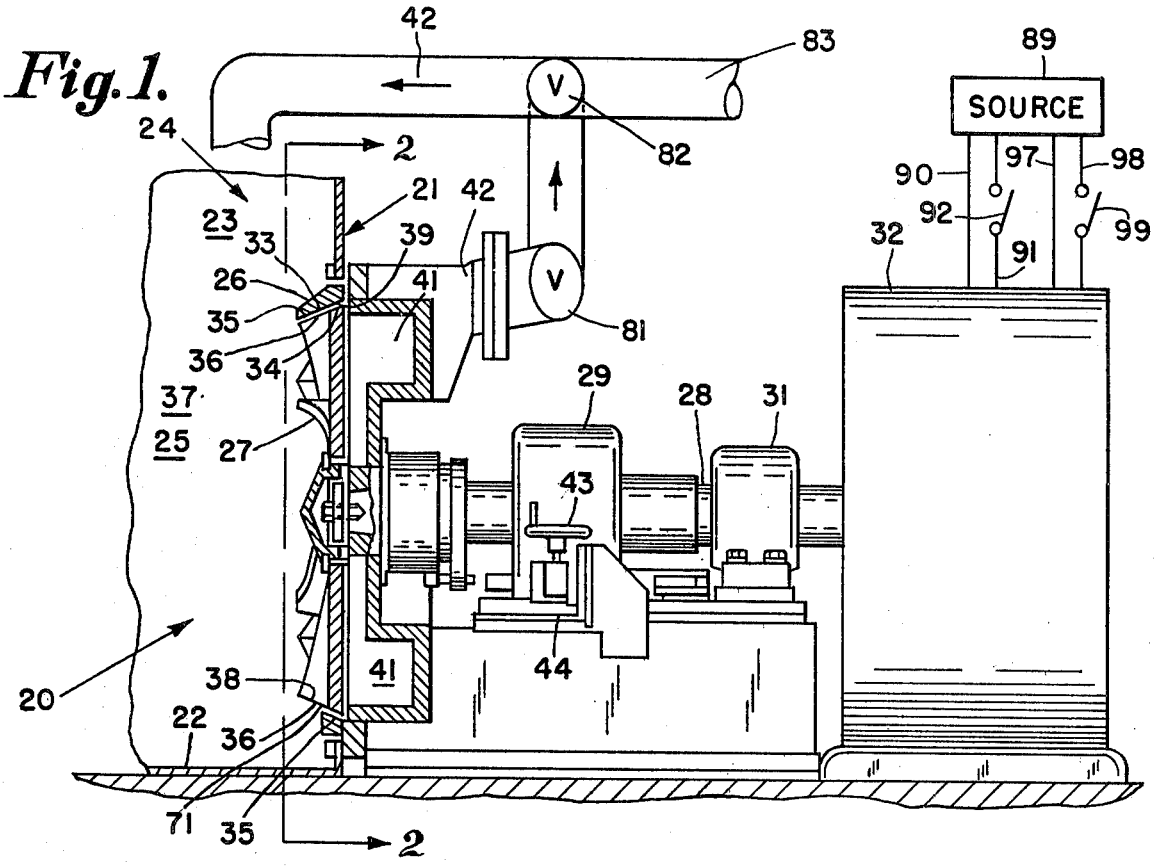
FIG. 1 is a fragmentary, side elevation of a typical vortical circulation pulper with a side wall rotor/stator driven by a reversible electric motor.
Figure 2:
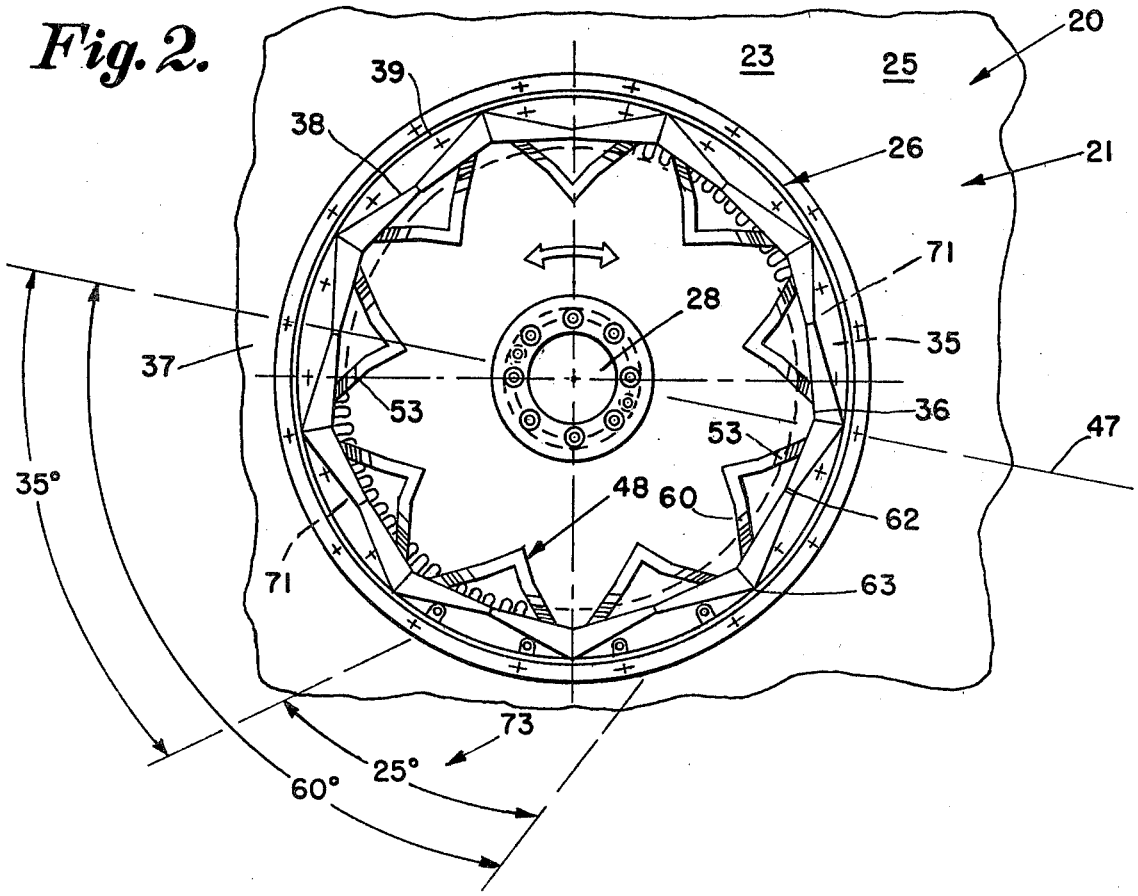
FIG. 2 is a front elevational view of the bi-directional rotor and bi-directional stator of the invention on line 2—2 of FIG. 1.

As shown in the drawings, the vortical circulation pulper 20 of the invention includes a stock container 21 having a bottom wall 22 and an upstanding side wall 23, there being an opening 24 at the top for receiving the charge 25 of the material to be pulped.

The charge 25 of material to be pulped is of stock difficult to, or impossible to, defiber in a conventional pulper with conventional clearance, thrust and horsepower for example, hemp, flax, rags, used mailbags, leather scraps, heavy latex impregnated shoe board, raw cotton and the like. When material is added to the water and pulping commenced in a conventional pulper either no defibering takes place or the pulping rotor and stator become plugged.

The zero clearance and fifty percent increase of thrust of my said U.S. Pat. No. 3,946,951 of Mar. 30, 1976 while more capable of defibering such material than conventional pulpers does so with increased wear on the parts.

In the vortical circulation pulper 20 of the invention an annular stator 26 of unique design is mounted, preferably in the side wall 23 of container 21, with a circular rotor 27, also of unique design rotatable within the stator and fast on a rotor shaft 28. Shaft 28 is cantilever supported in two spaced apart bearings 29 and 31 and driven by a reversible electric motor 32, or some other reversible power source well known in the art.

The stator 26 has a truncated conical, bladed and channeled attrition under face 33, and the rotor 27 has a truncated conical, bladed and channeled, attrition outer face 34, the faces 33 and 34 jointly forming a truncated conical attrition interface 35 with a small end 36, facing toward, and opening into, the interior 37 of the container 21 and forming the stock inlet 38. The large end 39 of the interface 35 faces away from the interior of the container and discharges defibered stock into the annular chamber 41.

Defibered stock may be conducted through conduit 42 and valves 81 and 82 back into container 21 for recirculation and treatment or may be conducted through conduit 83 to further processing. Valve 81 may also be used for partial closing of discharge conduit 42 to create back pressure at the interface 35 if desired.

The shaft 28, rotor 27 and bearings 29 and 31 are movable axially as a unit by the handwheel 43 and gear and rack mechanism 44 to advance and retract the truncated conical rotor outer face 34 relative to the truncated conical under face 33 of the stator to vary clearance. Preferably the clearance at interface 35 is about 5/1000 of an inch to 10/1000 of an inch so that undue wear is avoided.

The rotor 27 of this invention is provided with vortical circulation vanes 48, the vanes 48 being bi-directional and shaped in an annular, symmetrical pattern of alternate bladed peaks 45, of generally isosceles triangular configuration, and valleys, or channels, 46, also of generally isosceles triangular configuration.

Each peak 45 is upstanding from the disc, or plate-like, circular body 49 of the rotor, and includes a pair of inner, gradually inclined portions 50 and 51, each on an opposite side of the peak and each preferably angularly bent, as at 52, for accomplishing vortical circulation whether the rotor is rotated in one angular direction or in the opposite angular direction. Each inner portion 50 or 51 is angled to a radial line such as shown at 47 at an angle which is preferably about 35°.

Each peak 45, of each vortical circulation vane 48, also includes a pair of outer, stock reduction, edges such as 53 and 60, each on an opposite side thereof, the edges 53 and 60 of all of the peaks of the vanes 45, jointly outlining a truncated, conical bladed outerface 54 for use in reducing large chunks of the difficult to defiber stock 25 as they are moved clockwise or counter clockwise in a circular path designated by the hollow headed arrows, by the vortical circulation portions 51 of vanes 48.

Unlike the attrition blades and channels of the attrition face of the rotor of my above mentioned patent, and patent application, in this invention because both rotor 27 and stator 26 are bi-directional, the attrition blades 95, and the attrition channels 96, of the truncated conical outer face 34, of the bi-directional rotor 27 run generally radially, rather than being inclined, so as to shear and defiber regardless of direction of angular rotation.

The attrition blades 66 and the attrition channels 67 of the truncated conical under face 33 of the stator 26 are radial also, to form the truncated conical, stock attrition interface 35.

Preferably the outer bladed stock reduction edges 53 and 60 are not only sharply inclined at the preferred slope of about 60° from the plane of the body 49 of rotor 27, at the truncated conical interface 35, but they are also angled, in plan, in a preferred range of between thirty to forty degrees from a radial line such as 47, the preferred angle of each bladed edge 53 or 60, from its tip 55 to its high point 56, relative to radius 47, being about thirty-five degrees. The nose cone of rotor 27 is designated 58.

It will be understood that there is a wide variety of rotor and stator blade angles all of which would yield 35° intersection angle. As the rotor revolves, the leading edges 53 or 60 of a rotor vane describe a surface of revolution which is a section of a cone with the rotor disc as the base. Since the rotor blades are arranged perpendicular to the base, but are not radially oriented, the leading or trailing stock reduction edges are not coincident with the intersection of radial planes and the conical surface, rather the leading and trailing edges each exhibit a leading angle of 15° in the interfacial surface with respect to the axial plane depending on the direction of rotation.

On the other hand, the leading and trailing edges of each stator segment exhibit an angle substantially 50° to the axial plane in the interfacial surface. Thus the angle of intersection is 35°.

The stator 26 is also bi-directional and shaped in an annular, symmetrical, pattern of alternate, generally triangular peaks 59 and valleys 61, the generally triangular peaks 59 being formed in a one-piece ring, or constituting individual segments, for ease of replacement. Preferably each peak 59 and valley 61 is of isosceles triangle configuration in plan with the interior angle 62 at the apex and the exterior angle 63 at the bottom of each valley being obtuse.

It will be seen from FIG. 5 that the configuration of each peak, or triangular segment, 59 is unique in that it is not flat against the body 49 of rotor 27, but instead is inclined to form a portion of a truncated cone, with an outer face 64 and a truncated conical interface 65 having alternate attrition blades 66 and channels 67 running generally radially in the direction of radial line 47 on rotor 27. The outer peripheral edge 68 is normal to the plane of the body 49 of rotor 26, but curved to conform to the circular, annular configuration of the stator 26.

Each stator peak, or triangular segment, 59 includes a pair of acquisition, stock reduction edges 69 and 72 each on an opposite side thereof and facing toward the direction of travel of chunks being circulated by the vanes 48 of the rotating rotor 27, that direction being angularly in either opposite direction as shown by the hollow headed arrows. Each valley 61 in between each pair of acquisition edges 69 and 72 forms what I call an "acquisition space" for receiving large chunks of difficult to defiber stock so that such chunks are reduced in size by the successive scissors-like reduction impacts, rips, or tears of the outer bladed stock reduction edges 53 or 60 of the vanes 48 with the acquisition edges 69 or 72 of the peaks 59 of the stator 26. When the large chunks have been sufficiently reduced in size to permit the fibers therein to enter the attrition interface 35 they are further defibered therein and discharged from the large end 39 for further processing or recirculation.

The attrition interface 35 which is bladed and channeled for defibering is in rear of the stock reduction interface 71, both being truncated conical. The acquisition edge 72 and the acquisition edge 69 of each peak are slightly curved because formed by a flat plane intersecting a conical surface.

The angle of each acquisition edge 69 and 72 of each peak, to a radial line such as 47 passing through the bottom of the adjacent valley 61, is in a range of about fifty to seventy degrees and preferably about sixty degrees, when viewed in plan as in FIG. 3.

Preferably also the acquisition angle 73 which provides the preferred scissors-like reduction effect occurs when the bladed edges 53 or 60 of each rotor vane are angularly disposed to a radial line 47 at about 35°, and the acquisition edges 69 or 72 of each peak 59 are angularly disposed to the same radial line 47 at about 60° so that the acquisition angle 73 is about 25° (FIG. 6).

The acquisition angle remains about the same regardless of whether six to nine segments, or peaks are provided with six to nine vanes, or whether twenty or more peaks and valleys are provided. The number of peaks is a function of (1) rotor/stator diameter, and (2) material to be treated.

For example, with large, thick, heavy tough sheets, a 36" diameter unit would have nine segments and a similar number of vanes, with easier material, a 36" diameter unit would have eighteen segments and nine vanes.

It should be understood that two sets of interacting blades work simultaneously, the large bladed edges of the vortical circulation vanes cooperating with the acquisition edges of the peaks of the stator to enable gross size reduction of chunks in the acquisition spaces and the smaller attrition blades and channels of stator and rotor cooperating for final defibering.

The rotor/stator combination is required to perform four different functions: (1) agitation; (2) size reduction; (3) defibering (4) circulation. Optimum energy utilization requires optimizing each of these factors in each situation; i.e., enough, but not too much. If, for example, agitation is excessive, energy is wasted; if defibering is inefficient, productivity is reduced; etc. Proper "balance" is thus implied.

FIG. 6 is a diagrammatic representation of another embodiment of the bi-directional rotor 27, housed within a bi-directional stator 26, the vortical circulation vanes 74 forming an annular, symmetrical pattern 75 of alternate peaks 76 and valleys 77, each peak 76 having a pair of outer, stock reduction, bladed edges 78 and 79, each on an opposite side thereof and each of curved arcuate configuration. The darkened area on each peak represents the relative wide area 84 of each peak which engages the acquisition edges of the stator and the underface of the stator.

FIG. 7 is a view similar to FIG. 6 showing peaks 85 and valleys 86 on the bi-directional rotor 27, the contacting area 87, similar to area 84 being relatively narrow.

In FIG. 8, a plan view of the housing 40, chamber 41, and conduit 42 is shown to illustrate that the discharge conduit, in this invention extends radially, rather than tangentially in view of the bi-directional rotation of the rotor 27 within the stator 26.

The electric motor 32 is of the reversible type and the circuits thereto are shown diagrammatically as including a common source of electricity 89, conductors 90 and 91 and switch 92 for rotation in one angular direction and conductors 97, 98 and switch 99 for rotation in the opposite angular direction.

When certain types of relatively abrasive materials are processed, a progressive rounding of interfacial edges occurs which can impair performance, analogous to dull scissors. Such a progressive situation is illustrated in FIG. 9. It should be noted that, just as the leading edge is "eroded", so too is the interfacial area; thus, in order to maintain desired rotor/stator clearance, it is necessary from time to time to move the rotor assembly axially; nevertheless a progressive rounding of leading edges develops throughout life as shown in FIG. 9.

In contrast it will be seen in FIG. 10 that utilization of the bi-directional rotor and stator design of this disclosure permits periodic reversal of direction of rotation of sharp leading edges throughout life. It will be seen that, with this design, trailing edges necessarily remain sharp, thus reversal in direction of rotation enables utilization of these sharp edges for maximum efficiency. At the same time those edges that were leading then become trailing, and as the interface inevitably wears, these edges again become sharp, whereupon direction of rotation is again reversed, etc. Similarly, the same effects occur on the stator. In this way the unit can be said to be "self-sharpening"; i.e., edge effectiveness is maintained at maximum throughout life of rotating and stationary elements.

In this application I call the peaks and valleys in the stator and in the rotor of generally isosceles triangle configuration, meaning that the opposite sides of each peak are at equal angles and of equal length whether straight or slightly curved or angularly bent centrally thereof.

I claim:

1. A vortical circulation pulper comprising:

a stock container having a bottom wall and a side wall;

a bladed and channeled stator in one of said walls and a vaned, vortical-circulation rotor, rotatable within said stator to vortically circulate stock in said container;

said stator having a truncated conical, bladed and channeled underface, a smaller open end facing into said container and a larger open end facing away from said container;

said stator being bi-directional and shaped in an annular, symmetrical, pattern of alternate triangular, peaks and valleys, each peak having a pair of stock reduction, acquisition edges, each on an opposite side thereof;

vortical circulation vanes on said rotor, said vanes being bi-directional and shaped in an annular, symmetrical pattern of alternate peaks and valleys, each peak having a pair of outer stock reduction bladed edges thereon, each on an opposite side thereof, and each extending from an outer tip to a high point thereon said edges jointly outlining a truncated conical, bladed outer face;

the truncated conical, bladed and channeled underface of said stator and the truncated conical bladed outer face of said rotor forming a truncated-conical stock reduction interface;

said stator valleys constituting acquisition spaces, for receiving large chunks of said stock;

and the outer, stock reduction bladed edges of said rotor vanes cooperating with the stock reduction acquisition edges of the peaks of said stator at a predetermined acquisition angle to successively impart a scissors-like impact to said chunks received in said acquisition spaces to progressively reduce the size thereof for entering said stock reduction interface when said rotor is rotated clockwise or counter clockwise; and means for selectively rotating said rotor within said stator in a clockwise direction or in a counter clockwise direction.

2. A vortical circulation pulper of the type having a container, with a bottom wall and an upstanding side wall, for receiving difficult to defiber stock such as hemp, leather, cotton and the like, and having vortical circulation means mounted in one of said walls, including a rotor rotated in a circular path within a stator at predetermined clearance and thrust, said vortical circulation means characterized by:

said stator being bi-directional and shaped in an annular pattern of triangular segments defining alternate inwardly projecting triangular peaks, separated by triangular valleys, each successive valley forming an acquisition space for large chunks of said stock, each successive peak having a pair of opposite, stock reduction acquisition edges each angularly disposed to the path of stock moved in a circular path by the vanes of said rotor, and said stator having a truncated conical bladed and channeled underface and a small end facing the interior of said container;

said rotor being bi-directional and having vortical circulation vanes, spaced therearound, each with a pair of opposite outer bladed stock reduction edges, each angularly disposed to the radius of said rotor, said bladed edges jointly outlining a truncated conical outer face in a pattern of alternate peaks and valleys;

the truncated conical underface of said stator being spaced from the truncated conical outer face outlined by said rotor blade outer edges to form a truncated conical stock reduction interface for defibering stock reduced by a scissors-like effect imparted by the impacts of said rotor blade edges with successive acquisition edges on said segments; and means for rotating said rotor on said path in one angular direction until the edges are worn and then rotating said rotor in the opposite angular direction to sharpen said edges.

3. A vortical circulation pulper of the type having a pulp container with a bladed rotor and an annular, bladed stator mounted in a side, or bottom, wall thereof, said stator and rotor having a truncated conical attrition interface, of predetermined clearance, arranged to pump stock outwardly away from the center of said container, said pulper being characterized by:

said annular, bladed stator being bi-directional and having a plurality of triangular segments arranged symmetrically therearound to define an annular pattern of alternate peaks and valleys with a central stock inlet opening, each valley forming an acquisition space and the opposite edges of each peak forming a pair of acquisition edges;

said rotor being bi-directional and having spaced blades therearound which define an annular pattern of peaks and valleys, the inner portion of said vanes constituting vortical circulation vanes and the outer portion thereof forming a pair of opposite stock reduction blades, each cooperable with one of the acquisition edges of the peaks of the segments of said stator, depending on the direction of angular rotation of said stator, to form a stock reduction interface and to progressively reduce chunks of said stock received in the acquisition spaces of said stator to defibering size for acceptance in said attrition interface; and means for driving said rotor forwardly or reversely.

4. A vortical circulation pulper comprising:

a container for material to be pulped, said container having a bladed and channeled stator and rotor in one wall thereof with a predetermined, fixed, clearance truncated-conical, atrition interface therebetween;

said stator being annular and having an inner small end with a central opening and an outer large end and said rotor being bi-directional and having vortical circulation vanes thereon to create vortical circulation and agitation in said container by rotation in the central opening of said annular stator while pumping said material outwardly from the inner small end of said atrition interface to the outer large end of said attrition interface;

outer edges on said rotor vanes forming stock reduction blades jointly outlining a truncated conical stock reduction face rotating in a circular path;

said stator being bi-directional and comprising at least two oppositely disposed symmetrically arranged, spaced-apart triangular segments extending over the path of the stock reduction blades on said rotor and having stock reduction acquisition edges to form a stock reduction interface therewith;

said triangular segments forming an annular pattern of alternate peaks and valleys enabling chunks of said material to be accepted in said valleys and receive a scissors-like cut therealong from said stock reduction blades on said rotor as the material is circulated past individual and successive acquisition edges of the peaks of said segments and without being merely slid along said edges.

5. Apparatus for pulping difficult to defiber stock such as hemp, flax, rags, leather, or the like, said apparatus being of the type having:

a stock container for holding a charge of said stock in water for pulping;

circulation means for continuously circulating said charge in a path in said container;

stock reduction means, alongside said path, including a rotor and stator stock reduction interface for imparting successive scissors-like cutting impacts to large chunks of said stock to progressively reduce the size thereof to smaller pieces for entry into attrition means;

stock attrition means, alongside said path including a rotor and stator stock attrition interface in rear of said stock reduction interface for receiving said smaller sized pieces and defibering the same;

and means for continuously urging said chunks and pieces into said stock reduction interface and thence into said stock attrition interface and characterized by;

said stock reduction means being bi-directional with generally isosceles triangular peaks and valleys around said stator and generally isosceles triangular stock reduction edges around said rotor.

* * * * *